US008083872B2

(12) United States Patent
Mitchell et al.

(10) Patent No.: US 8,083,872 B2
(45) Date of Patent: Dec. 27, 2011

(54) METHOD OF HEAT TREATING A SUPERALLOY COMPONENT AND AN ALLOY COMPONENT

(75) Inventors: Robert J Mitchell, Nottingham (GB); David U Furrer, Zionsville, IN (US); Joseph A Lemsky, Waukesha, WI (US); Mark C Hardy, Derby (GB)

(73) Assignee: Rolls-Royce PLC, London (GB)

( * ) Notice: Subject to any disclaimer, the term of this patent is extended or adjusted under 35 U.S.C. 154(b) by 748 days.

(21) Appl. No.: 12/155,826

(22) Filed: Jun. 10, 2008

(65) Prior Publication Data

US 2009/0071580 A1 Mar. 19, 2009

Related U.S. Application Data

(60) Provisional application No. 60/935,285, filed on Aug. 3, 2007.

(51) Int. Cl.
*C21D 9/00* (2006.01)
*C22F 1/10* (2006.01)

(52) U.S. Cl. ..... 148/559; 148/675

(58) Field of Classification Search ..... 148/559, 148/675

See application file for complete search history.

(56) References Cited

U.S. PATENT DOCUMENTS

| | | | | |
|---|---|---|---|---|
| 5,269,857 | A | 12/1993 | Ganesh et al. | |
| 5,312,497 | A | 5/1994 | Mathey | |
| 5,527,020 | A * | 6/1996 | Ganesh et al. | 266/260 |
| 5,571,345 | A | 11/1996 | Ganesh et al. | |
| 6,610,110 | B1 | 8/2003 | Manka | |
| 6,660,110 | B1 | 12/2003 | Gayda et al. | |

FOREIGN PATENT DOCUMENTS

| | | | |
|---|---|---|---|
| EP | 0284876 | A1 | 10/1988 |
| EP | 1813690 | A1 | 8/2007 |

* cited by examiner

*Primary Examiner* — Jessee R. Roe
(74) *Attorney, Agent, or Firm* — Oliff & Berridge, PLC

(57) ABSTRACT

A method of heat treating a superalloy component includes solution heat treating the component at a temperature below the gamma prime solvus temperature to produce a fine grain structure. Insulation is placed over a first area to form an insulated assembly that is placed in a furnace at a temperature below the solvus temperature and maintained at that temperature for a predetermined time to achieve a uniform temperature. The temperature is increased at a predetermined rate to a temperature above the solvus temperature to maintain a fine grain structure in a first region, produce a coarse grain structure in a second region and produce a transitional structure in a third region between the first and second regions. The insulated assembly is removed from the furnace when the second region has been above the solvus temperature for a predetermined time and/or the first region has reached a predetermined temperature.

23 Claims, 4 Drawing Sheets

METHOD OF HEAT TREATING A SUPERALLOY COMPONENT AND AN ALLOY COMPONENT

CROSS-REFERENCE TO RELATED APPLICATIONS

This nonprovisional application claims the benefit of U.S. Provisional Application No. 60/935,285, filed Aug. 3, 2007.

BACKGROUND

The present invention relates to a method of heat treating a component, in particular to a method of heat treating a turbine disc, a compressor disc, a turbine cover plate, a compressor drum or a compressor cone.

Nickel superalloy components, or articles, e.g. discs, for gas turbine engines, undergo a simple heat treatment after thermo-mechanical forming to the component, or article, shape e.g. disc shape. Normally this is a single stage isothermal solution heat treatment at a temperature either above (supersolvus) the gamma prime solvus (γ') or below (subsolvus) the gamma prime solvus (γ'), followed by quenching in some medium, e.g. air or oil. The γ' solvus is the critical temperature in alloys of this nature.

Solution heat treating below the γ' solvus results in a fine grain microstructure, with a tri-modal distribution of the intermetallic strengthening phase, γ', termed primary, secondary and tertiary. Solution heat treating above the γ' solvus dissolves the primary γ' present on the grain boundaries and allows the grains to coarsen to yield a coarse grain structure and bi-modal γ' distribution, secondary and tertiary.

The solution heat treatment is then followed by a lower temperature age, or lower temperature ages, to relieve residual stresses that develop as a result of the quench and to refine the main strengthening precipitates for optimum mechanical properties. The single solution heat treatment temperature results in a component, e.g. a disc, with a uniform grain structure, either fine if a subsolvus solution heat treatment or coarse if a supersolvus solution heat treatment, and therefore a trade off in mechanical properties, performance, i.e. coarse grains for high temperature creep and fatigue crack growth resistance or fine grains for low temperature low cycle fatigue resistance and tensile strength.

It is known to provide a more complex heat treatment to a nickel superalloy component, e.g. a disc, this is dual-microstructure heat treatment, which results in a dual microstructure in the component, disc. The dual microstructure optimises the microstructure in different areas of the component, e.g. disc, based on the most important property for that area of the component in service, e.g. a fine grain structure in the hub, or bore, of the disc and a coarse grain structure in the rim of the disc. In this method the component is subject to a temperature gradient during the solution heat treatment. The rim of the disc is exposed to a temperature above the γ' solvus while the hub, or bore, of the disc is maintained at a temperature below the γ' solvus.

U.S. Pat. No. 6,610,110 discloses a method of heat treating a nickel superalloy disc comprising placing thermal bocks, heat sinks on the hub of the disc, enclosing the thermal blocks and the disc, except for the rim of the disc, within a shell and providing insulation within the shell, placing the assembly of disc, thermal blocks, shell and insulation in a furnace at a temperature above the gamma prime solvus temperature. The rim of the disc heats up at a faster rate than the insulated hub of the disc. The rim of the disc reaches a temperature above the gamma prime solvus temperature to coarsen the microstructure in the rim of the disc. A thermocouple is embedded in one of the thermal blocks and the assembly is removed when the thermocouple reaches a predetermined temperature. The disc has a diameter of 32 cm and an axial width of 5 cm at the hub and an axial width of 2.5 cm at the rim.

A problem with this method is that the discs used on larger gas turbine engines have much greater diameters and have much greater axial widths particularly at the hub of the disc. The greater size, and greater thermal mass, of the hub of these discs may result in the near surface regions of the hub reaching the equilibrium temperature, whilst the centre region of the hub reaching a much lower temperature, for example several hundred degrees centigrade lower. The centre region of the hub may be below the required subsolvus solution heat treatment temperature and in the ageing heat treatment regime. The effect of the hub of the disc obtaining a temperature significantly lower than the gamma prime solvus is to rapidly coarsen the gamma prime precipitates if the temperature is too low or to dissolve the gamma prime precipitates if the temperature is too high for ageing and too low for solution heat treatment. This would result in a disc with an overaged bore and a significant reduction in mechanical properties, thus negating the benefit of the dual microstructure heat treatment.

SUMMARY

Accordingly the present invention seeks to provide a novel method of heat treating a superalloy component which reduces, preferably overcomes, the above-mentioned problem.

Accordingly the present invention provides a method of heat treating a superalloy component comprising the steps of:— a) placing the component in a furnace and solution heat treating the component at a temperature below the gamma prime solvus temperature to produce a fine grain structure in the component,
b) cooling the component to ambient temperature,
c) placing insulation over at least one first predetermined area of the component and leaving at least one second predetermined area of the component without insulation to form an insulated assembly,
d) placing the insulated assembly of component and insulation in a furnace at a temperature below the gamma prime solvus temperature,
e) maintaining the insulated assembly at the temperature below the gamma prime solvus temperature for a predetermined time to achieve a uniform temperature in the component,
f) increasing the temperature in the furnace at a predetermined rate to a temperature above the gamma prime solvus temperature to maintain a fine grain structure substantially in a first region of the component, to produce a coarse grain structure substantially in a second region of the component and to produce a transitional structure in a third region positioned between the first region and the second region of the component,
g) removing the insulated assembly from the furnace when the second region of the component has been above the gamma prime solvus temperature for a predetermined time and/or the first region of the component has reached a predetermined temperature and
h) cooling the component to ambient temperature.

Preferably in step (f) the predetermined ramp rate is 110° C. per hour to 280° C. per hour.

The predetermined ramp rate in step (f) may be 110° C. per hour to produce a third region with a width of 30 mm to 80 mm.

The predetermined ramp rate in step (f) may be 220° C. per hour to produce a third region with a width of 15 mm to 40 mm.

Preferably step (h) comprises cooling the component at a rate of 0.1° C. per second to 5° C. per second.

Preferably the nickel base superalloy consists of 18.5 wt % cobalt, 15.0 wt % chromium, 5.0 wt % molybdenum, 3.0 wt % aluminium, 3.6 wt % titanium, 2.0 wt % tantalum, 0.5 wt % hafnium, 0.06 wt % zirconium, 0.027 wt % carbon, 0.015 wt % boron and the balance nickel plus incidental impurities.

Preferably the component comprises a turbine disc, a turbine rotor, a compressor disc, a turbine cover plate, a compressor cone or a compressor rotor.

Preferably the turbine disc or the compressor disc has a diameter of 60 cm to 70 cm, an axial width of 20 cm to 25 cm at the hub and an axial width of 3 cm to 7 cm at the rim.

Preferably the turbine disc or the compressor disc has a diameter of 66 cm, an axial width of 23 cm at the hub and an axial width of 5 cm at the rim.

Preferably step (c) comprises placing insulation on the radially extending faces of the turbine disc or the compressor disc and such that the second predetermined area of the turbine disc or the compressor disc is the rim of the turbine disc or compressor disc.

Preferably step (c) comprises placing a first disc shaped insulator on a predetermined area of a first radially extending face of the turbine disc or the compressor disc and placing a second disc shaped insulator on a predetermined area of a second radially extending face of the turbine disc or the compressor disc, the diameter of the first disc shaped insulator is less than the diameter of the turbine disc or the compressor disc and the diameter of the second disc shaped insulator is less than the diameter of the turbine disc or the compressor disc, such that a hub portion of the turbine disc or the compressor disc is covered by the insulation and a rim portion of the turbine disc or the compressor disc is not covered by insulation.

Preferably the first disc shaped insulator has a greater diameter than the second disc shaped insulator to provide a third region arranged at an angle relative to the axis of the disc.

Preferably the angle is 5° to 80°. Preferably the angle is 10° to 60°.

Alternatively step (c) comprises placing a first annular insulator on a predetermined area of first end of a compressor rotor or a compressor cone and placing a second annular insulator on a predetermined area of a second end of the compressor rotor or the compressor cone, such that a first end portion of the compressor rotor or the compressor cone is covered by the insulation, a second end portion of the compressor rotor or the compressor cone is covered by the insulation and a portion of the compressor rotor or the compressor cone between the first and second end portions is not covered by insulation.

Preferably the insulation comprises a ceramic material. Preferably the ceramic material comprises alumina and/or iron oxide.

Preferably a container is provided in a space within the hub of the turbine disc or the compressor disc, the container containing a low melting point metal or low melting point alloy. Preferably the low melting point metal or low melting point alloy has a melting point 20° C. to 150° C. below the gamma prime solvus temperature of the component. Preferably the low melting point metal is copper.

The present invention also provides an alloy component comprising a fine grain structure substantially in a first region of the component, a coarse grain structure substantially in a second region of the component and a transitional structure in a third region positioned between the first region and the second region of the component.

Preferably the component is a turbine disc or a compressor disc, the disc comprising a hub portion, a rim portion and a web portion interconnecting the hub portion and the rim portion, the fine grain structure is in the hub portion of the disc, the coarse grain structure is in the rim portion of the disc and a transitional structure is in the web portion of the disc.

Preferably the transitional structure is arranged at an angle to the axis of the disc.

Preferably the disc has an axially upstream end and an axially downstream end, the position of the transitional grain structure is at a greater radial distance from the axis of the disc at the axially downstream end of the disc than at the axially upstream end of the disc and the transitional structure is at a progressively greater distance from the axis of the disc in going from the axially upstream end of the disc to the axially downstream end of the disc.

Preferably the angle is in the range 5° to 80°, more preferably the angle is in the range 10° to 60°.

The present invention also provides an alloy disc, the disc comprising a hub portion, a rim portion and a web portion interconnecting the hub portion and the rim portion, the disc has a first axial end and a second axial end, the disc comprising a fine grain structure substantially in a first region of the disc, a coarse grain structure substantially in a second region of the disc, the fine grain structure is in the hub portion of the disc, the coarse grain structure is in the rim portion of the disc, the coarse grain structure extends a greater distance radially inwardly from the rim portion into the web portion on the first axial end of the disc than on the second axial end of the disc and the fine grain structure extends a greater distance radially outwardly from the hub portion into the web portion on the second axial end of the disc than on the first axial end of the disc.

Preferably the fine grain structure extends a progressively greater distance radially outwardly from the axis of the disc in going from the first axial end of the disc to the second axial end of the disc.

Preferably a transitional structure is in a third region positioned between the first region and the second region of the disc, the transitional structure is in the web portion of the disc.

Preferably the position of the transitional grain structure is at a greater radial distance from the axis of the disc at the second axial end of the disc than at the first axial end of the disc and the transitional structure is at a progressively greater distance from the axis of the disc in going from the first axial end of the disc to the second axial end of the disc.

Preferably the disc is a turbine disc or a compressor disc.

Preferably the disc is a titanium alloy disc or a superalloy disc, more preferably a nickel superalloy disc.

The present invention also provides a method of heat treating a superalloy a disc comprising the steps of:— a) placing the disc in a furnace and solution heat treating the disc at a temperature below the gamma prime solvus temperature to produce a fine grain structure in the disc, b) cooling the disc to ambient temperature, c) placing insulation over at least one first predetermined area of the disc and leaving at least one second predetermined area of the disc without insulation to form an insulated assembly, placing insulation on the radially extending faces of the disc and such that the second predetermined area of the disc is the rim of the disc, placing a first disc shaped insulator on a predetermined area of a first radially extending face of the disc and placing a second disc shaped insulator on a predetermined area of a second radially extending face of the disc, the diameter of the first disc shaped insulator is less than the diameter of the disc and the diameter of the second disc shaped insulator is less than the diameter of the disc, such that a hub portion of the disc is covered by the insulation and a rim portion of the disc is not covered by insulation, the first disc shaped insulator has a greater diameter than the second disc shaped insulator, d) placing the insulated assembly of disc and insulation in a furnace at a temperature below the gamma prime solvus temperature, e) maintaining the insulated assembly at the temperature below the gamma prime solvus temperature for a predetermined time to achieve a uniform temperature in the disc, f) increasing the temperature in the furnace at a predetermined ramp rate to a temperature above the gamma prime solvus temperature to maintain a fine grain structure substantially in a first region of the disc, to produce a coarse grain structure substantially in a second region of the disc and to produce a transitional structure in a third region positioned between the first region and the second region of the disc and the third region is arranged at an angle relative to the axis of the disc, g) removing the insulated assembly from the furnace when the second region of the disc has been above the gamma prime solvus temperature for a predetermined time and/or the first region of the disc has reached a predetermined temperature and h) cooling the disc to ambient temperature.

The present invention also provides a method of heat treating a superalloy disc comprising the steps of:— a) placing the disc in a furnace and solution heat treating the disc at a temperature below the gamma prime solvus temperature to produce a fine grain structure in the disc, b) cooling the disc to ambient temperature, c) placing a container in a space within the hub of the disc, the container containing a low melting point metal or low melting point alloy, placing insulation over at least one first predetermined area of the disc and leaving at least one second predetermined area of the disc without insulation to form an insulated assembly, d) placing the insulated assembly of disc, container and insulation in a furnace at a temperature below the gamma prime solvus temperature, e) maintaining the insulated assembly at the temperature below the gamma prime solvus temperature for a predetermined time to achieve a uniform temperature in the disc, f) increasing the temperature in the furnace at a predetermined ramp rate to a temperature above the gamma prime solvus temperature to maintain a fine grain structure substantially in a first region of the disc, to produce a coarse grain structure substantially in a second region of the disc and to produce a transitional structure in a third region positioned between the first region and the second region of the disc, g) removing the insulated assembly from the furnace when the second region of the disc has been above the gamma prime solvus temperature for a predetermined time and/or the first region of the disc has reached a predetermined temperature and h) cooling the disc to ambient temperature.

The present invention also provides a method of heat treating a titanium alloy component comprising the steps of:— a) placing the component in a furnace and solution heat treating the component at a temperature below the beta solvus temperature to produce a fine grain structure in the component, b) cooling the component to ambient temperature, c) placing insulation over at least one first predetermined area of the component and leaving at least one second predetermined area of the component without insulation to form an insulated assembly, d) placing the insulated assembly of component and insulation in a furnace at a temperature below the beta solvus temperature, e) maintaining the insulated assembly at the temperature below the beta solvus temperature for a predetermined time to achieve a uniform temperature in the component, f) increasing the temperature in the furnace at a predetermined rate to a temperature above the beta solvus temperature to maintain a fine grain structure substantially in a first region of the component, to produce a coarse grain structure substantially in a second region of the component and to produce a transitional structure in a third region positioned between the first region and the second region of the component, g) removing the insulated assembly from the furnace when the second region of the component has been above the beta solvus temperature for a predetermined time and/or the first region of the component has reached a predetermined temperature and h) cooling the component to ambient temperature.

BRIEF DESCRIPTION OF THE DRAWINGS

The present invention will be more fully described by way of example with reference to the accompanying drawings in which:—

DESCRIPTION OF EXEMPLARY EMBODIMENTS

Figure 1:
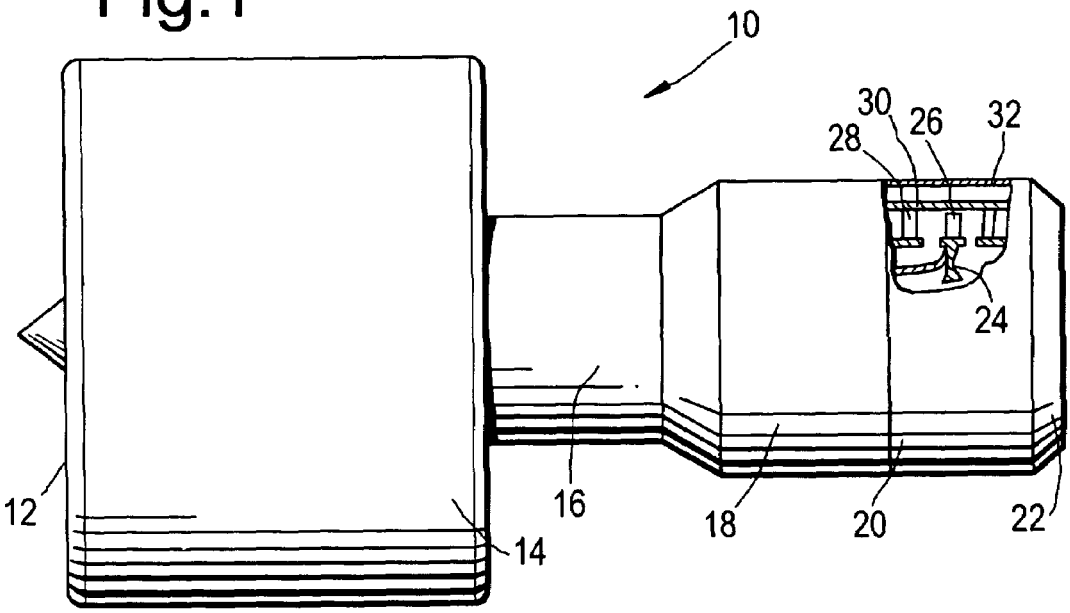
FIG. 1 is a cut away view of a turbofan gas turbine engine having a turbine disc heat treated according to the present invention.

A turbofan gas turbine engine 10 comprises in axial flow series an intake 12, a fan section 14, a compressor section 16, a combustion section 18, a turbine section 20 and an exhaust 22. The turbine section 20 comprises a high pressure turbine 24, 26 arranged to drive a high pressure compressor (not shown) in the compressor section 16 via a shaft (not shown), an intermediate pressure turbine (not shown) arranged to drive an intermediate pressure compressor (not shown) in the compressor section 16 via a shaft (not shown) and a low pressure turbine (not shown) arranged to drive a fan (not shown) in the fan section 14 via a shaft (not shown). The turbofan gas turbine engine 10 operates quite conventionally.

A portion of the turbine section 20 is shown in FIG. 1 comprising a high pressure turbine disc 24 carrying a plurality of circumferentially spaced radially outwardly extending high pressure turbine blades 26. The high pressure turbine blades 26 are provided with firtree roots, which locate in correspondingly shaped slots in the rim of the high pressure turbine disc 24. A plurality of circumferentially spaced nozzle guide vane 28 are arranged axially upstream of the high pressure turbine blades 26 to direct hot gases from the combustion section 18 onto the high pressure turbine blades 26. The nozzle guide vanes 28 are supported at their radially outer ends by an inner casing 30 and the inner casing 30 is enclosed by an outer casing 32.

Figure 2:
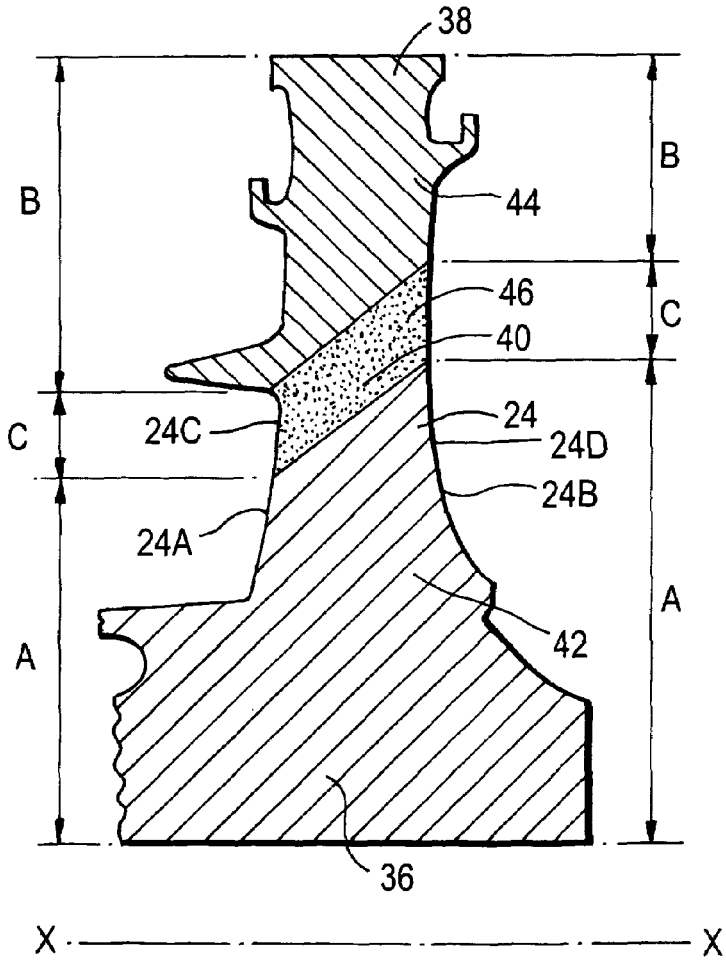
FIG. 2 shows an enlarged cross-sectional view of a turbine disc heat treated according to the present invention.

A high pressure turbine disc 24 as shown more clearly in FIG. 2 comprises a hub portion 36, at the radially inner end of the high pressure turbine disc 24, a rim portion 38 at the radially outer end of the turbine disc 24 and a web portion 40 extending radially between and interconnecting the hub portion 36 and the rim portion 38. The high pressure turbine disc 24 consists of a nickel base superalloy, in this example the nickel base superalloy consists of 18.5 wt % cobalt, 15.0 wt % chromium, 5.0 wt % molybdenum, 3.0 wt % aluminium, 3.6 wt % titanium, 2.0 wt % tantalum, 0.5 wt % hafnium, 0.06 wt % zirconium, 0.027 wt % carbon, 0.015 wt % boron and the balance nickel plus incidental impurities. However, other suitable nickel base superalloys may be used. The turbine disc 24 has a diameter of 60 cm to 70 cm, an axial width of 20 cm to 25 cm at the hub portion 36 and an axial width of 3 cm to 7 cm at the rim portion 38, in particular the turbine disc 24 has a diameter of 66 cm, an axial width of 23 cm at the hub portion 36 and an axial width of 5 cm at the rim portion 38.

FIG. 2 shows the high pressure turbine disc 24 in the as heat treated condition. The hub portion 36 of the high pressure turbine disc 24 has received a subsolvus solution heat treatment, e.g. a solution heat treatment below the gamma prime solvus temperature, and has a fine grain structure 42. The rim portion 38 of the high pressure turbine 24 has received a supersolvus solution heat treatment, e.g. a solution heat treatment above the gamma prime solvus, and has a coarse grain structure 44. The web portion 40 also has a fine grain structure 42 adjacent the hub portion 36 and a coarse grain structure 44 adjacent the rim portion 38 but also has a transitional grain structure 46 at a position between the fine grain structure 42 and the coarse grain structure 44.

It is to be noted, in this example, that the transitional grain structure 46, or the transition from the fine grain structure 42 to the coarse grain structure 44 is at arranged at an angle to the axis X-X of the high pressure turbine disc 24, or the position of the transitional grain structure 46 is at a greater radial distance from the axis X-X at the axially downstream end 24B of the turbine disc 24 than at the axially upstream end 24A of the turbine disc 24 and the transitional structure 46 is at a progressively greater distance from the axis X-X in going from the axially upstream end 24A to the axially downstream end 24B. This angle is in the range 5° to 80°, more preferably the angle is in the range 10° to 60°.

This angling of the transitional structure 46 is beneficial to the turbine disc 24, because in service the turbine disc 24 is subjected to an axial temperature gradient in addition to a radial temperature gradient, e.g. a point at a radial distance from the X-X axis on the axially upstream end 24A of the turbine disc 24 is at a higher temperature than a point at the same radial distance from the X-X axis on the axially downstream end 24B of the turbine disc 24. The angling of the transitional structure 46 is better suited to the mechanical property and microstructural requirements of the turbine disc 24. The axially upstream end 24A of the turbine disc 24 is subjected to a higher operating temperature and therefore is provided with a microstructure that is more resistant to high temperature creep and dwell fatigue crack growth and hence has a coarse grain structure 44. The axially downstream end 24B of the turbine disc 24 is subjected to a lower operating temperature and therefore is provided with a microstructure that is more resistant to low cycle fatigue and has better tensile strength. This results in an angled transitional structure 46, the coarse grain structure 44 extends a greater distance radially inwardly from the rim portion 38 into the web portion 40 on the axially upstream end 24A than on the axially downstream end 24B and on the contrary the fine grain structure 42 extends a greater distance radially outwardly from the hub portion 36 into the web portion 40 on the axially downstream end 24B than on the axially upstream end 24A.

The transitional grain structure 46 comprises a grain structure with a grain size between that of the fine grain structure 42 and the coarse grain structure 44. The transitional grain structure 46 comprises a trimodal gamma prime distribution where the relative volume fractions of each of the three populations of gamma prime is different to that found in the fine grain structure 42. In particular in the transitional grain structure 46 the volume fraction of primary gamma prime decreases with increasing radial distance from the X-X axis and there is an associated increase in the volume fractions of both the secondary gamma prime and the tertiary gamma prime.

Figure 3:
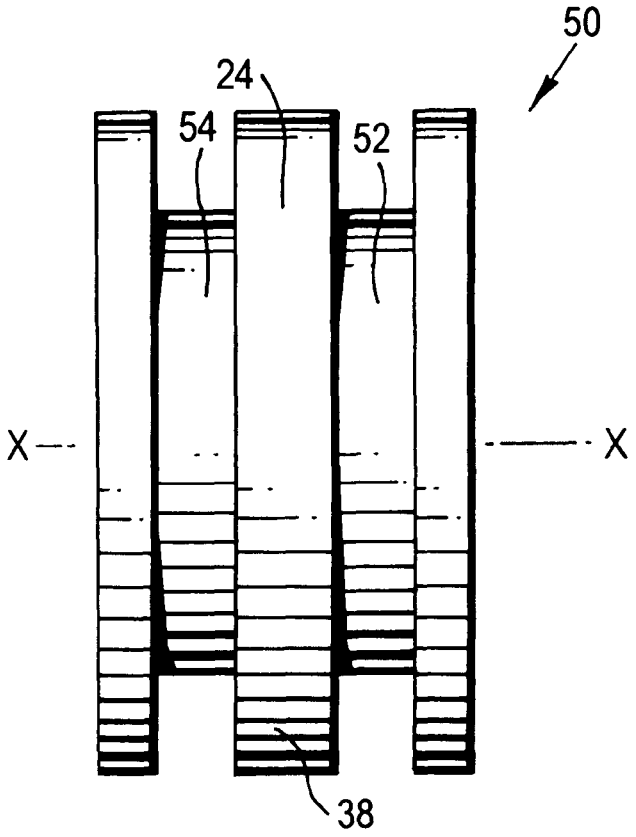
FIG. 3 shows an enlarged view of a turbine disc in an insulated assembly for use in the heat treatment according to the present invention.

A method of heat treating the nickel superalloy turbine disc 24, according to the present invention is illustrated with reference to FIG. 3 and comprises placing the turbine disc 24 in a furnace and solution heat treating the turbine disc 24 at a temperature below the gamma prime solvus temperature to produce a fine grain structure 42 in the turbine disc 24. Then the turbine disc 24 is cooled to ambient temperature using any suitable method known to those skilled in the art.

Next insulation 52, 54 is placed over at least one first predetermined area, the hub portion 36 and the web portion 40, of the turbine disc 24 but at least one second predetermined area, the rim portion 38, of the turbine disc 24 is left without insulation to form an insulated assembly 50. The insulation 52, 54 is placed on the radially extending faces 24C and 24D at the axially upstream and downstream ends of 24A and 24B respectively of the turbine disc 24 and such that the second predetermined area of the turbine disc 24 is the rim portion 38 of the turbine disc 24. In particular a first disc shaped insulator 52 is placed on a predetermined area of a first radially extending face 24D of the turbine disc 24 and a second disc shaped insulator 54 is placed on a predetermined area of a second radially extending face 24C of the turbine disc 24. The diameter of the first disc shaped insulator 52 is less than the diameter of the turbine disc 24 and the diameter of the second disc shaped insulator 54 is less than the diameter of the turbine disc 24, such that the hub portion 36 and the web portion 40 of the turbine disc 24 is covered by the insulation and the rim portion 38 of the turbine disc 24 is not covered by insulation.

Any suitable insulation may be used but preferably the insulation comprises a ceramic material, e.g. alumina and/or iron oxide. The insulation comprises a ceramic, which has excellent thermal insulation properties and excellent thermal shock properties. The ceramic insulation is easily formed to the desired shape, for example the ceramic may be easily cast to the required shape. The ceramic insulation is reusable. Alternatively, the insulation may comprise a metal foam or a composite material. A gap may be provided between the insulation and the turbine disc and the gap may contain air, a loose fibre refractory or a fibre refractory blanket to provide additional insulation properties.

The insulated assembly 50 of turbine disc 24 and insulation 52, 54 is placed in a furnace at a temperature below the gamma prime solvus temperature. The temperature in the furnace and hence the temperature of the insulated assembly 50 is maintained at the temperature below the gamma prime solvus temperature for a predetermined time to achieve a uniform temperature in the turbine disc 24.

Then the temperature in the furnace is increased at a predetermined rate to a temperature above the gamma prime solvus temperature to maintain a fine grain structure 42 substantially in a first region A of the turbine disc 24, to produce a coarse grain structure 44 substantially in a second region B of the turbine disc 24 and to produce a transitional structure 46 in a third region C positioned between the first region A and the second region B of the turbine disc 24.

The insulated assembly 50 is removed from the furnace when the second region B of the turbine disc 24 has been above the gamma prime solvus temperature for a predetermined time and/or the first region A of the turbine disc 24 has reached a predetermined temperature. A further advantage of the present invention is that the insulation 52, 54, the insulator discs, may be quickly removed prior to quenching, and does not delay the quench, to obtain the desired properties in the turbine disc 24 or compressor disc etc.

Finally the turbine disc 24 is cooled to ambient temperature, using any suitable method well known to those skilled in the art.

The predetermined ramp rate controls the position and the width of the transitional structure 46. A greater ramp rate produces a greater temperature gradient radially in the turbine disc 24 from hub portion 36 to rim portion 38 and hence a narrower transitional structure 46. On the contrary a lower ramp rate produces a lower temperature gradient radially in the turbine disc 24 from hub portion 36 to rim portion 38 and hence a wider transitional structure 46. The grain size and primary gamma prime size and volume fraction vary significantly in the third region C and it is possible to optimise the microstructure/nanostructure to optimise mechanical properties such that they are either closer to the properties of the coarse grain structure 44 in the second region B or closer to the properties of the fine grain structure 42 in the first region A.

The predetermined ramp rate is 110° C. (200° F.) per hour to 280° C. (500° F.) per hour. If the predetermined ramp rate is 110° C. per hour a third region C with a width of 30 mm to 80 mm is produced, depending on the chemistry of the superalloy. If the predetermined ramp rate is 220° C. (400° F.) per hour a third region C with a width of 15 mm to 40 mm is produced.

The cooling rate for the transitional structure 46 in the third region C is carefully controlled through selection of the cooling, quenching, medium and flow rate. Compressed air cooling is easily varied with position on the turbine disc 24. The cooling rate directly influences the mechanical properties. Higher cooling rates may be used to provide improved tensile properties and on the contrary lower cooling rates may be used to provide improved fatigue crack propagation resistance. The turbine disc 24 is cooled at a rate of 0.1° C. per second to 5° C. per second.

The first and second disc shaped insulators 52 and 54 have the same diameter and therefore the third region C is substantially parallel to the engine axis X-X.

Figure 4:
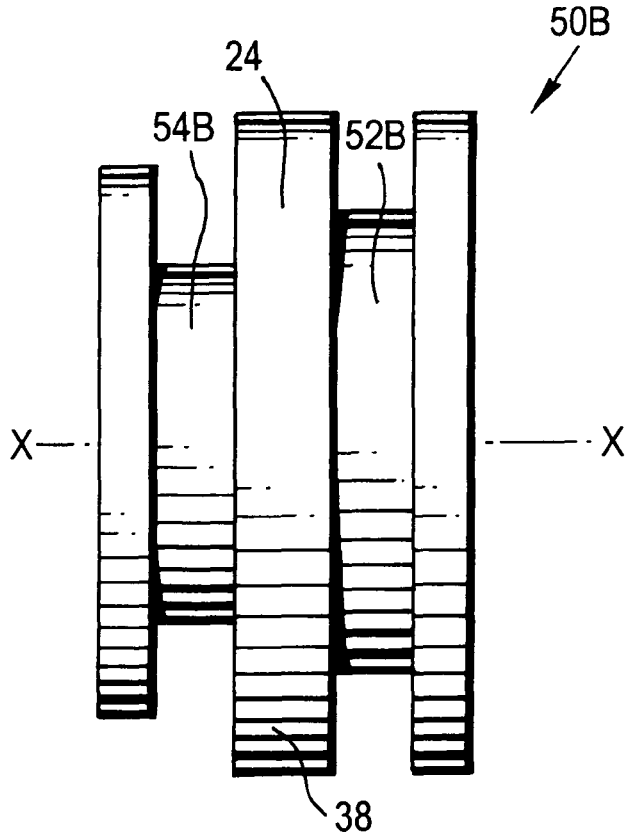
FIG. 4 shows an enlarged view of a turbine disc in an alternative insulated assembly for use in the heat treatment according to the present invention.

Another method of heat treating the nickel superalloy turbine disc 24, according to the present invention is illustrated with reference to FIG. 4. The method is substantially the same as that described with reference to FIG. 3, but differs in that the first disc shaped insulator 52B has a greater diameter than the second disc shaped insulator 54B to provide a third region C arranged at an angle relative to the axis X-X of the turbine disc 24, as shown in FIG. 2. The diameter of the first disc shaped insulator 52B is less than the diameter of the turbine disc 24 and the diameter of the second disc shaped insulator 54B is less than the diameter of the turbine disc 24, such that the hub portion 36 and the web portion 40 of the turbine disc 24 is covered by the insulation and the rim portion 38 of the turbine disc 24 is not covered by insulation.

The invention is also applicable to the intermediate pressure turbine discs and to the low pressure turbine discs of the gas turbine engine.

Figure 5:
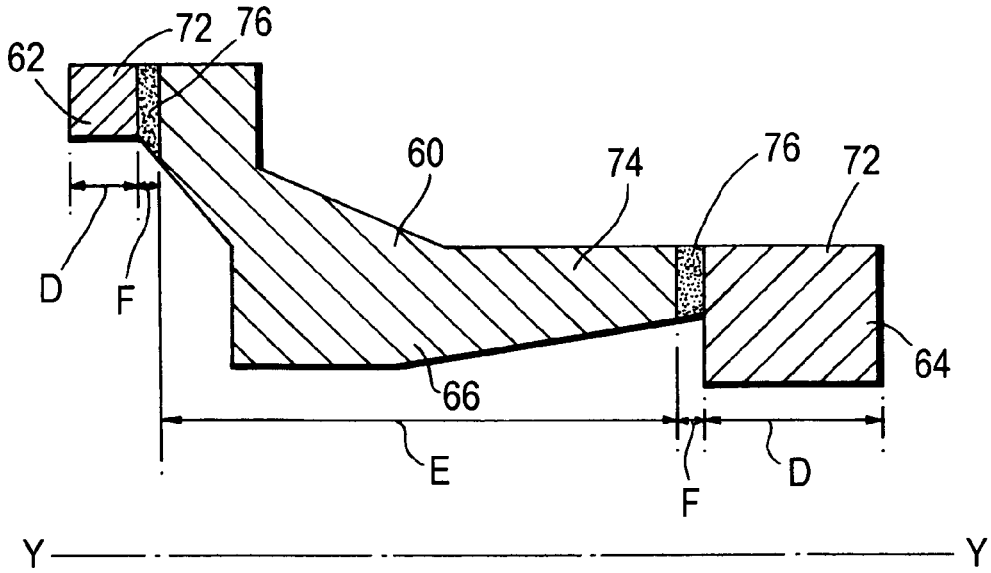
FIG. 5 shows an enlarged cross-sectional view of a compressor cone heat treated according to the present invention.
Figure 6:
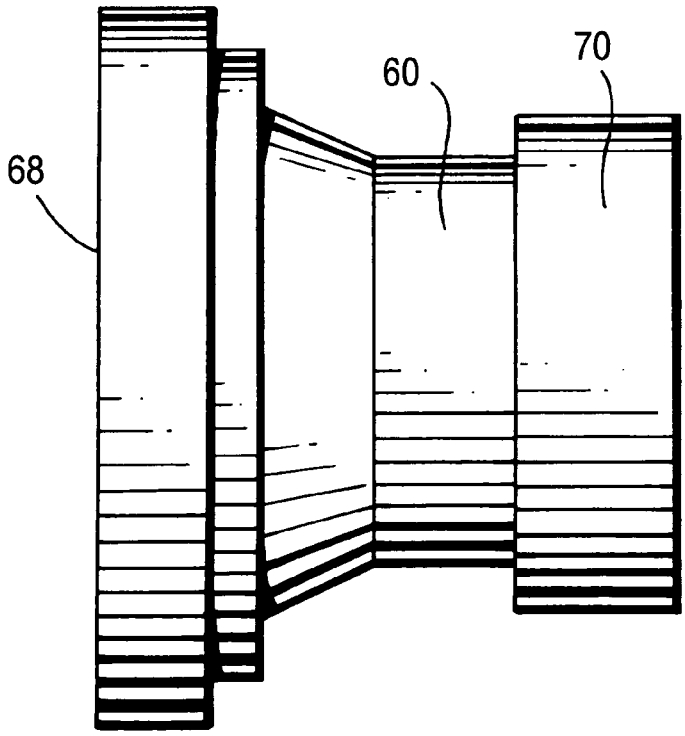
FIG. 6 shows an enlarged view of a compressor cone in an insulated assembly for use in the heat treatment according to the present invention.

A further method of heat treating a nickel superalloy compressor cone 60, according to the present invention is illustrated with reference to FIGS. 5 and 6. The compressor cone 60 is placed in a furnace and solution heat treated at a temperature below the gamma prime solvus temperature to produce a fine grain structure 72 in the compressor cone 60. Then the compressor cone 60 is cooled to ambient temperature using any suitable method.

This method comprises placing a first annular insulator 68 on a predetermined area of first end 62 of the compressor cone 60 and placing a second annular insulator 70 on a predetermined area of a second end 64 of the compressor cone 60, such that a first end portion of the compressor cone 60 is covered by the insulation, a second end portion of the compressor cone 60 is covered by the insulation and a portion of the compressor cone 60 between the first and second end portions is not covered by insulation. The first annular insulator 68 and the second annular insulator 70 have annular grooves to receive the first end 62 and second end 64 respectively.

The whole assembly of compressor cone 60 and first and second insulators 68 and 70 are placed in a furnace at a temperature below the gamma prime solvus temperature.

The temperature in the furnace is increased at a predetermined rate to a temperature above the gamma prime solvus temperature to maintain a fine grain structure 72 substantially in a first region D of the compressor cone 60, to produce a coarse grain structure 74 substantially in a second region E of the compressor cone 60 and to produce a transitional structure 76 in a third region F positioned between the first region D and the second region E of the compressor cone 60.

This enables a high pressure compressor cone 60 to be produced with a coarse grain structure provided in the hotter regions, where creep properties are required, and a fine grain structure provided in the end regions to optimise low cycle fatigue life to enable ease of joining, welding, e.g. inertia welding. The use of a fine grain structure at the end regions is desirable due to the ease with which fine grain structure material may be welded compared to a coarse grain structure material, in particular the resultant microstructures are less dissimilar for fine grain inertia welds after joining.

Figure 7:
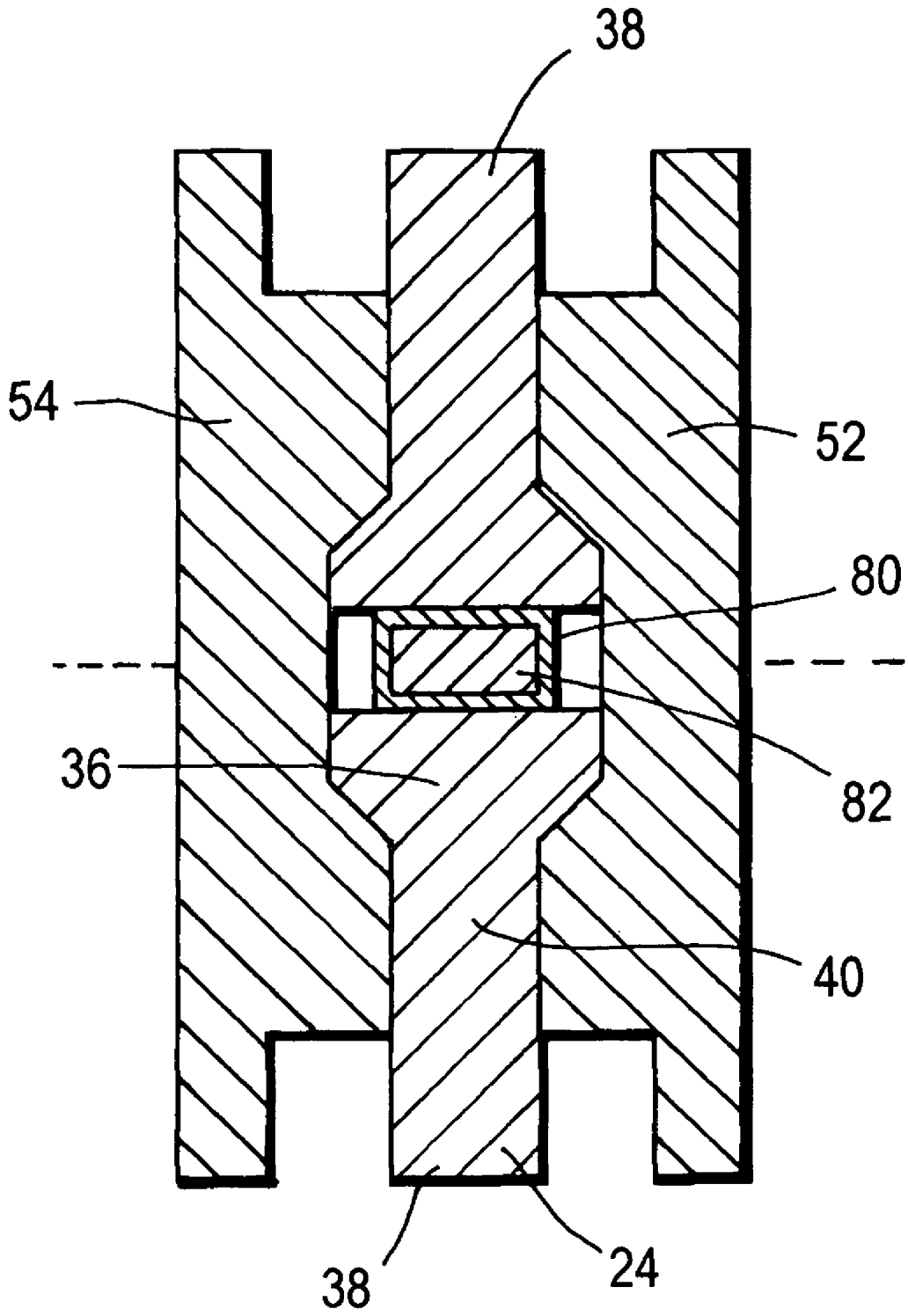
FIG. 7 shows an enlarged cross-sectional view of a turbine disc in an alternative insulated assembly for use in the heat treatment according to the present invention.

A further method of heat treating a nickel superalloy turbine disc according to the present invention is shown in FIG. 7. This method of heat treating is substantially the same as those described with reference to FIG. 3, or FIG. 4, but differs in that a container 80 is provided in a space within the hub portion 36 of the turbine disc 24. The container 80 contains a low melting point metal, or a low melting point alloy, 82. The container 80 comprises a metal, or alloy, the same as or similar to the metal, or alloy, e.g. nickel base superalloy of the turbine disc 24. The low melting point metal, or low melting point alloy, 82 has a melting point 20° C. to 150° C. below the gamma prime solvus temperature. The low melting point metal is for example copper, which has a melting temperature of 1084° C. The container 80 is arranged in thermal contact with the turbine disc 24 to provide an optimum path for heat flow and therefore the matching of coefficients of thermal expansion is important. The container 80 containing the low melting point metal, or the low melting point alloy, may be reused.

During the heat treatment the low melting point metal, or the low melting point alloy, melts and changes from a solid to a liquid and extra heat, enthalpy of fusion, must be provided to the low melting point metal, or low melting point alloy, in order for it to change state.

The heat treatment is arranged to maintain the hub portion 36 of the turbine disc 24 at a temperature below the gamma prime solvus temperature, ideally within a narrow range below the subsolvus solution temperature. Therefore the low melting point metal, or low melting point alloy, acts to cool the bore portion 36 of the turbine disc 24 by absorbing more heat energy by virtue of the phase change from solid to liquid at a temperature less than the gamma prime solvus temperature of the turbine disc 24 being heat treated is advantageous. The presence of the low melting point metal, or low melting point alloy, enables the turbine disc 24 to remain in the furnace for a longer period of time, e.g. it enables a greater processing window. The container 80 and the low melting point metal, or alloy, increases the temperature gradient in the turbine disc 24 between the hub portion 36 and the rim portion 38 and hence reduces the width of the transitional structure 46.

It may be possible to deposit a high emissivity coating, or other suitable coating, onto the second predetermined area of the component, e.g. the rim of the disc, which is not covered by insulation, prior to heat treatment to control the rate at which heat flows into the second predetermined area of the component. The coating may increase, or decrease, the rate at which heat flows into the component.

Although the present invention has been described with reference to a turbine disc and a compressor cone it is equally applicable to a compressor disc, a compressor rotor, a turbine rotor, a turbine cover plate or a rotor interseal. In the case of a compressor disc the transitional grain structure, or the transition from the fine grain structure to the course grain structure may be arranged at an angle to the axis of the compressor disc, or the position of the transitional grain structure is at a greater radial distance from the axis at the axially upstream end of the compressor disc than at the axially downstream end of the compressor disc and the transitional structure is at a progressively greater distance from the axis in going from the axially downstream end to the axially upstream end. This angle is in the range 50 to 80°, more preferably the angle is in the range 10° to 60°. This is because the downstream end of the compressor disc is at a higher temperature than the upstream end of the compressor disc.

The heat treatment according to the present invention is also applicable to a turbine disc comprising two or more alloys, which are chosen to have optimum properties in different locations in the turbine disc, e.g. at different radial positions. The two or more alloys are generally formed into rings, which preferably are then joined, bonded, together. The two or more alloys will have different gamma prime solvus temperatures. In that instance it may be that the rim portion of the turbine disc is enclosed by insulation and the hub portion of the turbine disc is exposed.

Typical gamma prime solvus temperatures of nickel based superalloys are 1120° C. to 1190° C. The furnace is heated to a solution heat treatment temperature, a first predetermined temperature below the gamma prime solvus temperature of the nickel based superalloy, e.g. 15° C. to 35° C. below the gamma prime solvus temperature, to produce the fine grain structure throughout the component, e.g. turbine disc. The insulated assembly is heated to a second predetermined temperature below the solution heat treatment temperature to produce a uniform temperature throughout the component. The insulated assembly is heated to a third predetermined temperature above the gamma prime solvus temperature, this temperature is low enough to avoid dissolution of the carbide and/or boride phases in the nickel based superalloy. The transition region is at a temperature above the gamma prime solvus temperature, but only for a limited amount of time.

Although the present invention has been described with reference to nickel superalloys, the present invention is also applicable to the heat treatment of other alloys, for example cobalt superalloys and titanium alloys. In the case of near alpha titanium alloys, instead of heat treating with respect to the gamma prime solvus temperature, the heat treatment is with respect to the beta solvus temperature.

It may be possible to provide a computer model, computational model, of the heat treatment process in order to optimise the heat treatment. The computer model may be used to optimise the heat flux or heat treatment, by optimising the insulation members, thermal mass, latest heat of transformation to obtain the desired transient heating profile, or thermal gradient.

We claim:

1. A method of heat treating a superalloy component comprising the steps of:

a) placing the component in a furnace and solution heat treating the component at a temperature below a gamma prime solvus temperature to produce a fine grain structure in the component, b) cooling the component to ambient temperature, c) placing insulation over at least one first predetermined area of the component and leaving at least one second predetermined area of the component without insulation to form an insulated assembly, d) placing the insulated assembly of component and insulation in the furnace at a temperature below the gamma prime solvus temperature, e) maintaining the insulated assembly at the temperature below the gamma prime solvus temperature for a predetermined time to achieve a uniform temperature in the component, f) increasing the temperature in the furnace at a predetermined rate to a temperature above the gamma prime solvus temperature to maintain a fine grain structure substantially in a first region of the component, to produce a coarse grain structure substantially in a second region of the component and to produce a transitional structure in a third region positioned between the first region and the second region of the component, g) removing the insulated assembly from the furnace when the second region of the component has been above the gamma prime solvus temperature for a predetermined time and/or the first region of the component has reached a predetermined temperature and h) cooling the component to ambient temperature.

2. A method as claimed in claim 1 wherein in step (f) the predetermined ramp rate is 110° C. per hour to 280° C. per hour.

3. A method as claimed in claim 1 wherein the insulation comprises a ceramic material.

4. A method as claimed in claim 3 wherein the ceramic material comprises alumina and/or iron oxide.

5. A method as claimed in claim 2 wherein in step (f) the predetermined ramp rate is 110° C. per hour to produce a third region with a width of 30 mm to 80 mm.

6. A method as claimed in claim 2 wherein in step (f) the predetermined ramp rate is 220° C. per hour to produce a third region with a width of 15 mm to 40 mm.

7. A method as claimed in claim 1 wherein step (h) comprises cooling the component at a rate of 0.1° C. per second to 5° C. per second.

8. A method as claimed in claim 1 wherein the superalloy is a nickel base superalloy.

9. A method as claimed in claim 8 wherein the nickel base superalloy consists of 18.5 wt % cobalt, 15.0 wt % chromium, 5.0 wt % molybdenum, 3.0 wt % aluminium, 3.6 wt % titanium, 2.0 wt % tantalum, 0.5 wt % hafnium, 0.06 wt % zirconium, 0.027 wt % carbon, 0.015 wt % boron and the balance nickel plus incidental impurities.

10. A method as claimed in claim 1 wherein the component comprises a turbine disc, a turbine rotor, a compressor disc, a turbine cover plate, a compressor cone or a compressor rotor.

11. A method as claimed in claim 10 comprising placing a first annular insulator on a predetermined area of a first end of a compressor rotor or a compressor cone and placing a second annular insulator on a predetermined area of a second end of the compressor rotor or the compressor cone, such that a first end portion of the compressor rotor or the compressor cone is covered by the insulation, a second end portion of the compressor rotor or the compressor cone is covered by the insulation and a portion of the compressor rotor or the compressor cone between the first and second end portions is not covered by insulation.

12. A method as claimed in claim 10 comprising providing a container in a space within a hub portion of the turbine disc or the compressor disc, the container containing a low melting point metal or low melting point alloy.

13. A method as claimed in claim 12 wherein the low melting point metal or low melting point alloy has a melting point 20° C. to 150° C. below the gamma prime solvus temperature of the component.

14. A method as claimed in claim 13 wherein the low melting point metal is copper.

15. A method as claimed in claim 10 wherein the turbine disc or the compressor disc includes a hub and a rim, and has a diameter of 60 cm to 70 cm, an axial width of 20 cm to 25 cm at the hub and an axial width of 3 cm to 7 cm at the rim.

16. A method as claimed in claim 15 wherein the turbine disc or the compressor disc has a diameter of 66 cm, an axial width of 23 cm at the hub and an axial width of 5 cm at the rim.

17. A method as claimed in claim 10 wherein step (c) comprises placing insulation on the radially extending faces of the turbine disc or the compressor disc and such that the second predetermined area of the turbine disc or the compressor disc is a rim portion of the turbine disc or compressor disc.

18. A method as claimed in claim 17 wherein step (c) comprises placing a first disc shaped insulator on a predetermined area of a first radially extending face of the turbine disc or the compressor disc and placing a second disc shaped insulator on a predetermined area of a second radially extending face of the turbine disc or the compressor disc, the diameter of the first disc shaped insulator is less than the diameter of the turbine disc or the compressor disc and the diameter of the second disc shaped insulator is less than the diameter of the turbine disc or the compressor disc, such that a hub portion of the turbine disc or the compressor disc is covered by the insulation and the rim portion of the turbine disc or the compressor disc is not covered by insulation.

19. A method as claimed in claim 18 wherein the first disc shaped insulator has a greater diameter than the second disc shaped insulator to provide a third region arranged at an angle relative to the axis of the disc.

20. A method as claimed in claim 19 wherein the angle is 5° to 80°.

21. A method as claimed in claim 20 wherein the angle is 10° to 60°.

22. A method of heat treating a superalloy disc comprising the steps of:

a) placing the disc in a furnace and solution heat treating the disc at a temperature below a gamma prime solvus temperature to produce a fine grain structure in the disc, b) cooling the disc to ambient temperature, c) placing insulation over at least one first predetermined area of the disc and leaving at least one second predetermined area of the disc without insulation to form an insulated assembly, placing insulation on the radially extending faces of the disc and such that the second predetermined area of the disc is a rim of the disc, placing a first disc shaped insulator on a predetermined area of a first radially extending face of the disc and placing a second disc shaped insulator on a predetermined area of a second radially extending face of the disc, the diameter of the first disc shaped insulator is less than the diameter of the disc and the diameter of the second disc shaped insulator is less than the diameter of the disc, such that a hub portion of the disc is covered by the insulation and a rim portion of the disc is not covered by insulation, the first disc shaped insulator has a greater diameter than the second disc shaped insulator, d) placing the insulated assembly of disc and insulation in the furnace at a temperature below the gamma prime solvus temperature, e) maintaining the insulated assembly at the temperature below the gamma prime solvus temperature for a predetermined time to achieve a uniform temperature in the disc, f) increasing the temperature in the furnace at a predetermined ramp rate to a temperature above the gamma prime solvus temperature to maintain a fine grain structure substantially in a first region of the disc, to produce a coarse grain structure substantially in a second region of the disc and to produce a transitional structure in a third region positioned between the first region and the second region of the disc and the third region is arranged at an angle relative to the axis of the disc, g) removing the insulated assembly from the furnace when the second region of the disc has been above the gamma prime solvus temperature for a predetermined time and/or the first region of the disc has reached a predetermined temperature and h) cooling the disc to ambient temperature.

23. A method of heat treating a superalloy disc comprising the steps of:

a) placing the disc in a furnace and solution heat treating the disc at a temperature below a gamma prime solvus temperature to produce a fine grain structure in the disc, b) cooling the disc to ambient temperature, c) placing a container in a space within a hub of the disc, the container containing a low melting point metal or low melting point alloy, placing insulation over at least one first predetermined area of the disc and leaving at least one second predetermined area of the disc without insulation to form an insulated assembly, d) placing the insulated assembly of disc, container and insulation in the furnace at a temperature below the gamma prime solvus temperature, e) maintaining the insulated assembly at the temperature below the gamma prime solvus temperature for a predetermined time to achieve a uniform temperature in the disc, f) increasing the temperature in the furnace at a predetermined ramp rate to a temperature above the gamma prime solvus temperature to maintain a fine grain structure substantially in a first region of the disc, to produce a coarse grain structure substantially in a second region of the disc and to produce a transitional structure in a third region positioned between the first region and the second region of the disc, g) removing the insulated assembly from the furnace when the second region of the disc has been above the gamma prime solvus temperature for a predetermined time and/or the first region of the disc has reached a predetermined temperature and h) cooling the disc to ambient temperature.

* * * * *